US006014822A

United States Patent [19]

Smith

[11] Patent Number: 6,014,822

[45] Date of Patent: Jan. 18, 2000

[54] FOOT COVER INSERTS FOR SANDALS

[76] Inventor: Catherine V. Smith, 4244 E. 131st. Pl., Thornton, Colo. 80241

[21] Appl. No.: 09/226,834

[22] Filed: Jan. 7, 1999

Related U.S. Application Data

[60] Provisional application No. 60/071,206, Jan. 12, 1998.

[51] Int. Cl.[7] ..... A43B 19/00

[52] U.S. Cl. ..... 36/10; 36/96; 36/95; 36/11.5

[58] Field of Search ..... 36/10, 11.5, 95, 36/96, 7.2, 7.4, 7.7

[56] References Cited

U.S. PATENT DOCUMENTS

| | | |
|---|---|---|
| 2,292,770 | 8/1942 | Platkin . |
| 2,889,639 | 6/1959 | Rudine . |
| 2,952,926 | 9/1960 | Laven . |
| 3,099,884 | 8/1963 | Kixmiller et al. . |

FOREIGN PATENT DOCUMENTS

| | | |
|---|---|---|
| 102797 | 1/1938 | Australia . |
| 472261 | 8/1952 | Italy . |

*Primary Examiner*—Ted Kavanaugh

[57] ABSTRACT

A foot cover insert (1) adapted to be slid over a wearer's foot (2) and to cover the instep and sides of the foot for keeping feet inside straps (3) of sandal shoes (4). The foot cover insert having an upper (5) consisting of a clear, smooth, firm, pliable, vinyl material; and a flat sole (6) consisting of a thin cork material or a fabric material that has a heavy grain. The upper (5) and sole (6) joined together at their edges to form a tubular shaped member with an enlarged first opening (7) to permit the insert to be slid over the foot of the wearer, and an enlarged second opening (8) at the front of the tubular member. The insert (1) adapted to cover only the portion of the foot between the toes and the instep, as shown in FIGS. 2 and 4, wherein the foot cover insert (10 can be removed and placed in any type of sandal and give a smooth and perfect look to the foot hiding imperfections of the foot and keep the foot within the boundaries of the sandal.

1 Claim, 1 Drawing Sheet

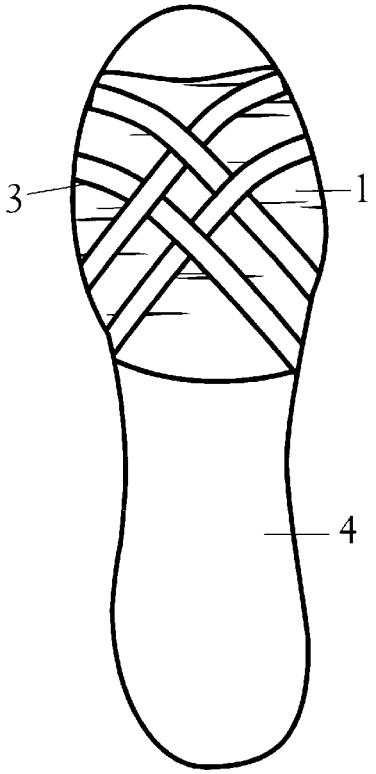
Fig. I
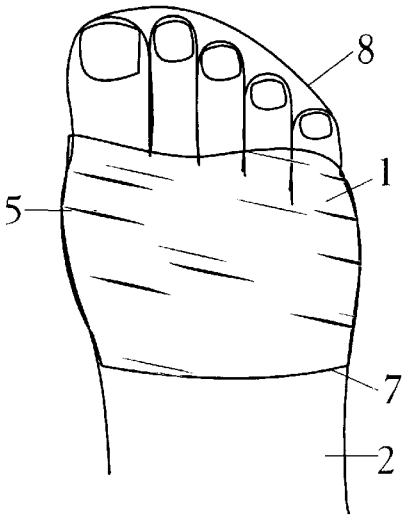
Fig. II
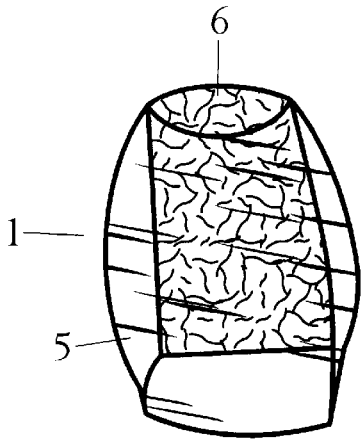
Fig. III
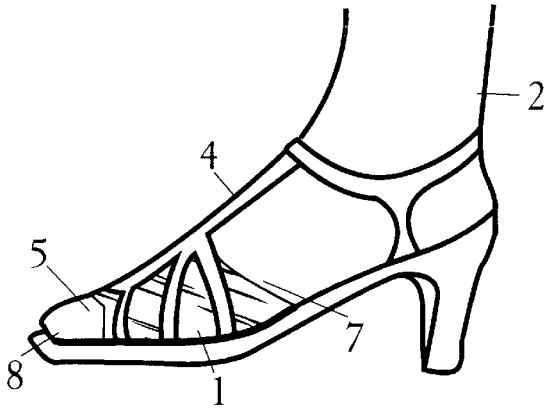
Fig. IV

FOOT COVER INSERTS FOR SANDALS

This application claims the benefits of Provisional application Ser. No. 60/071,206, filed on Jan. 12. 1998.

BACKGROUND OF THE INVENTION

{a} Field of the Invention

This invention generally relates to the field of attachment devices and systems, and more particularly, but not by way of limitation, to a device and method for keeping toes, bunions imperfect feet inside the straps of sandal shoes. Giving a smooth look to the foot and enjoying the ability of wearing sandals with only a few straps across the instep of the shoe. Imperfect feet cannot wear sandals, now they can.

{b} I have not found any other device that is separate from the shoe, that can be removed and placed in other sandals, but have the effect of keeping feet within the boundaries of an enclosed shoe, yet giving the appearance of an open sandal.

{c} Thus there remains a need to present to women, imparticular, who have imperfect feet, to be able to wear sandals in hot climates and also to wear with summer clothing, a product that can serve the purpose of enclosed shoe and yet appear to be a open sandal, with the befit of air circulation in the openness of the toe, arch and heel.

SUMMARY

It has been discovered to solve the above problem, by producing an insert for the foot to be placed into the sandal that can be removed and used in other sandals. The insert includes the following elements:

a} Having an upper and sides curved surface and a flat undersurface.

b} The upper and sides of the insert is made of a clear vinyl material firm but plyable. The undersurface or sole of the insert is made of a thin cork material and or a fabric material that has a heavy grain.

c} These inserts will be made in all ladies shoe sizes as well as men sizes.

The embodiment of the shoe insert covers across the top of the instep of the foot and down the sides of the foot. This insert is made of clear vinyl material which is plyable but firm to hold toes and bunions in place giving a smooth and perfect look to the foot. The vinyl material is attached to the under surface or sole which is made of thin cork or fabric, attached to a permanent adhesive heat set. The under surface or sole of the shoe insert, material being cork or coarse grain fabric prevents the insert from sliding forward, keeping it within the confines of the sandal shoe.

It should also be understood that while the above and other advantages and results of the present invention will become apparent to those skilled in the art from the following detailed description and accompanying drawings, showing the contemplated novel construction, combinations and elements as herein described, and more defined by the appended claims, it is understood that changes in the precise embodiments of the herein disclosed invention are meant to be included within the scope of the claims, except insofar as they may be precluded by the prior art.

The Accompanying drawings illustrate referred embodiments of the present invention according to the best mode presently devised for making and using the instant invention, and in which:

FIG. 1 is a top view plan view of the invention illustrating the insert within the sandal shoe.

FIG. 2 is a foot shown within the insert, showing all the toes.

FIG. 3 insert alone standing on end.

FIG. 4 side view of insert within a sandal with foot in the insert, and both within the sandal.

DETAILED DESCRIPTION

FIGS. 1–4 show a foot cover insert 1 adapted to be slid over a wearer's foot 2 and to cover the instep and sides of the foot for keeping feet inside straps 3 of sandal shoes 4. The foot cover insert having an upper 5 consisting of a clear, smooth, firm, pliable, vinyl material; and a flat sole 6 consisting of a thin cork material or a fabric material that has a heavy grain. The upper 5 and sole 6 joined together at their edges to form a tubular shaped member with an enlarged first opening 7 to permit the insert to be slid over the foot of the wearer, and an enlarged second opening 8 at the front of the tubular member. The insert 1 adapted to cover only the portion of the foot between the toes and the instep, as shown in FIGS. 2 and 4, wherein the foot cover insert 1 can be removed and placed in any type of sandal and give a smooth and perfect look to the foot hiding imperfections of the foot and keep the foot within the boundaries of the sandal.

What is claimed is:

1. A foot cover insert adapted to be slid over a wearer's foot and to cover the instep and sides of the foot for keeping feet inside straps of sandal shoes, said foot cover insert consisting of:

an upper consisting of a clear, smooth, firm, pliable, vinyl material; and a flat sole consisting of a thin cork material;

said upper and sole joined together at their edges to form a tubular shaped member with an enlarged first opening to permit the insert to be slid over the foot of the wearer, and an enlarged second opening at the front of the tubular member, said insert adapted to cover only the portion of the foot between the toes and the instep, wherein the foot cover insert can be removed and placed in any type of sandal and give a smooth and perfect look to the foot hiding imperfections of the foot and keep the foot within the boundaries of the sandal.

* * * * *

UNITED STATES PATENT AND TRADEMARK OFFICE

CERTIFICATE OF CORRECTION

PATENT NO. : 6,014,822
DATED : January 18, 2000
INVENTOR(S) : Catherine V. Smith It is certified that error appears in the above-identified patent and that said Letters Patent is hereby corrected as shown below:

Title Page,
Item [57] lines 5 and 6, delete "consisting of a thin cork material or a fabric material that has a heavy grain," and insert --consisting of a thin cork material and or a fabric material and or leather and or vinyl.--

Column 1,
Lines 37-39, delete "The undersurface or sole of the insert is made of a thin cork material and or a fabric material that has a heavy grain." and insert --The undersurface of solen of the insert is made of a thin cork material and or a fabric material and or leather and or vinyl.--

Column 2,
Lines 25 and 26 delete, delete "consisting of a thin cork material or a fabric material that has a heavy grain." and insert --consisting of a thin cork material and or a fabric material and or leather and or vinyl.--

Signed and Sealed this

Thirty-first Day of July, 2001

*Attest:*

Nicholas P. Godici

NICHOLAS P. GODICI
*Acting Director of the United States Patent and Trademark Office*

*Attesting Officer*

UNITED STATES PATENT AND TRADEMARK OFFICE

CERTIFICATE OF CORRECTION

PATENT NO. : 6,014,822
DATED : January 18, 2000
INVENTOR(S) : Catherine V. Smith It is certified that error appears in the above-identified patent and that said Letters Patent is hereby corrected as shown below:

Title page,
Item [57] lines 5 and 6, delete "consisting of a thin cork material or a fabric material that has a heavy grain," and insert -- consisting of a thin cork material and or a fabric material and or leather and or vinyl. --

Column1,
Lines 37-39, delete "The undersurface or sole of the insert is made of a thin cork material and or a fabric material that has a heavy grain." and insert -- The under surface or sole of the insert is made of a thin cork material and or a fabric material and or leather and or vinyl. --

Column 2,
Lines 25 and 26 delete, delete "consisting of a thin cork material or a fabric material that has a heavy grain." and insert -- consisting of a thin cork material and or a fabric material and or leather and or vinyl. --

This certificate supersedes certificate of correction issued July 31, 2001.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*